United States Patent [19]

Coe et al.

[11] 4,167,700

[45] Sep. 11, 1979

[54] DIGITAL VOICE PROTECTION SYSTEM AND METHOD

[75] Inventors: Richard H. Coe, Carpentersville; Daniel J. McQuade, Roselle; David L. Weiss, Schaumburg, all of Ill.

[73] Assignee: Motorola, Inc., Schaumburg, Ill.

[21] Appl. No.: 792,969

[22] Filed: May 2, 1977

[51] Int. Cl.[2] ..... H04K 1/00

[52] U.S. Cl. ..... 325/32; 179/1.5 R; 325/39; 325/315; 343/202

[58] Field of Search ..... 179/1.5 R; 178/22; 325/32, 34, 39, 315, 325; 343/202

[56] References Cited

U.S. PATENT DOCUMENTS

| | | | |
|---|---|---|---|
| 3,507,980 | 4/1970 | Rugaber et al. | 179/1.5 R |
| 3,624,297 | 11/1971 | Chapman | 179/1.5 R |
| 3,639,690 | 2/1972 | Braun et al. | 178/22 |
| 3,674,936 | 7/1972 | Wolfe | 179/1.5 R |
| 3,686,571 | 8/1972 | Fathauer | 179/1.5 R |
| 3,688,197 | 8/1972 | Kahn | 325/315 |
| 3,909,534 | 9/1975 | Majeau et al. | 179/1.5 R |
| 3,920,894 | 11/1975 | Shirley | 178/22 |
| 4,020,285 | 4/1977 | Branscome et al. | 179/1.5 R |

*Primary Examiner*—Howard A. Birmiel

*Attorney, Agent, or Firm*—James W. Gillman; Victor Myer

[57] ABSTRACT

A digital voice privacy electronic communication system and method provides protection for an information signal. Either a clear voice signal or a scrambled digitized version of the voice signal is selected for transmission. At the receive end of the system a determination that a clear voice signal or a scrambled signal has been sent is made. This information is used to automatically switch the clear audio signal if present to an output circuit or to switch to the output circuit either a regenerated version of the scrambled signal or an unscrambled version of the information signal. The switching is done automatically so that a user does not have to manually select the proper receiver mode in response to reception of a signal, that is, whether the received signal was a clear voice signal or a scrambled signal. At the transmitter the information signal to be scrambled is analog-to-digital converted and the digital signal is then put into a scrambled form. The scrambled signal may be then processed through base stations, repeaters, satellite receivers, etc., while still in the digitally scrambled form, thereby providing a high degree of protection for such a signal. A receiver may regenerate, or reshape, the scrambled digital signals or the signal may be unscrambled in the receiver depending upon whether the receiver is part of, for example, a repeater system or is a terminal destination for the signal. The digital privacy system of this invention may also be utilized in signal voting systems, either analog or digital, while still maintaining, if necessary, the secure format of the scrambled information.

4 Claims, 15 Drawing Figures

DIGITAL VOICE PROTECTION SYSTEM AND METHOD

BACKGROUND OF THE INVENTION

1. Field of the Invention

This invention relates to systems and methods for protecting privacy encoded electronic information signals.

2. Description of the Prior Art

In the operation of many two-way radio communication systems, as well as other communication systems, it is a requirement that unauthorized reception and detection of certain sensitive information messages be prevented. In sending such sensitive information signals throughout a system, particularly a large system such as used by a metropolitan police department, it is necessary that the signal remain in a secure format while it is being passed through a large number of system components. A secure signal format should be maintained while the signal is being transmitted, for example, from a portable unit to a satellite receiver, through a repeater, through a base station receiver, through telephone lines linking the aforesaid components, and through audio interconnect and patching systems. Many analog voice privacy systems having limited security are available such as those using frequency inversion, band splitting, and other types of analog signal scrambling. It has been found that a high degree of security is obtained in a digital scrambling system in which a voice information signal, for example, is first analog-to-digital converted with the digital signals resulting therefrom being then encoded into a scrambled form by using shift registers and various gates to thereby produce a pseudorandomly encoded, or scrambled, signal.

Various digital scrambling systems are available, which are useful only for point-to-point, single path communications such as, for example, from a portable to a portable unit, from a mobile to a base unit, or from a base to a base unit. These systems have no facility for multisystem interconnecting. In order for a scrambled message to be transmitted throughout a system it is often necessary to decode, or unscramble, the message to the original message format before reencoding, which provides a potential access point for an intruder into an otherwise secure communication network. When it is desirable to change the scrambler/unscrambler code keys in such a system, it is necessary to insert the new codes at each equipment site, a time-consuming, inconvenient procedure.

Scramblers for a mobile or a portable system are generally considered accessories to such systems and do not readily adapt themselves to full system operation. Portable radios, in particular, have not been widely adapted for use in protected communication systems. In order for these portables to be used most effectively they must be used in systems which have satellite receiver voting systems, that is, systems which select the best received signal from a plurality of receive sites and send that best signal to a central location. Digital scrambling systems are generally not compatible with the analog voting system capabilities used in some satellite receiver systems of the prior art. Many prior art scrambler accessories require signal bandwidths much greater than available in standard communication system equipment. These accessories cannot be used in multi-equipment linked systems having standard system bandwidths and components.

Another problem in the prior art is that because the digital scramblers do not use standard channel bandwidths for transmitting signals, it is not possible to intermix scrambled and non-scrambled equipment in a system effectively. Thus, separate dedicated radio channels for scrambled and unscrambled are required. Prior art digital scrambler systems, thus, do not lend themselves to transparent operation, that is, operation in which the signal being transmitted is handled properly by the system components whether the signal is in a scrambled form or otherwise.

Finally, prior art digital scramblers used in systems are not capable of automatically selecting between either an ordinary audio channel when an ordinary audio signal is present or a digital scrambler channel when a scrambled signal is present. This ability of a communication system to automatically determine whether a channel has a clear voice, that is, an unscrambled signal present thereupon or a coded, or scrambled, signal present thereupon is desirable in order to eliminate the necessity of a message receiver having prior knowledge of the form of a message about to be received.

Consequently, the need for an improved digitally protected privacy coded electronic communication method and system exists.

SUMMARY OF THE INVENTION

Accordingly, it is an object of this invention to provide an improved digital privacy coded electronic communication system and method for digitally protecting an information signal.

A further object of this invention is to provide a system and method of transmitting and receiving digitally encoded privacy messages so that unauthorized reception of the contents of such messages is prevented.

Another object of this invention is to provide a means by which secure digital messages may be transmitted through a large number of unsecured system components.

Another object of this invention is to provide a system for maintaining secure messages independent of the degree of physical security provided for the system components.

Another object of this invention is to provide a system in which transparent operation is obtained and in which no code keys are required to be changed at remote locations.

Another object of this invention is to provide a method and system in which portable radio equipment utilizes satellite receiver system, said systems having both analog and digital voting capabilities.

Another object of this invention is to provide digital privacy coded messages which may be communicated through standard bandwidth two-way communication channels and systems.

Another object of this invention is to provide means by which an automatic determination of the presence of a clear audio or a scrambled signal is made.

Accordingly, this invention provides a transmitting means which includes means for providing a clear signal and a privacy coded information signal as well as means for selectively transmitting said signals. Receiving means for selectively receiving said signals are also provided. Enabling means enable the receiving means to automatically select one of a representative clear or a representative privacy encoded signals in response to the presence of the one signal. According to an aspect of the invention, the privacy encoded signal providing means includes digital conversion means and means for scrambling the digitally converted signal. Means for regenerating the scrambled signal at the receiver are provided according to another aspect of the invention. The scrambled signal is unscrambled and converted from a digital format to the original information signal format in accordance with another aspect of the invention. Synchronous clock means are provided for the converting, scrambling, regenerating, unscrambling and reconverting. A plurality of transmitting and receiving means according to the invention are provided for maintaining a secure privacy encoded signal transmission link. Another aspect of the invention includes means for providing control signals indicative of the signal quality of the received clear signal and of the received privacy encoded signal. In response to the control signals one of the signals is switched to an output terminal. According to another aspect of the invention a plurality of receiving means each contain privacy encoded signal regenerating means and means for automatically selecting a regenerated privacy encoded signal as a clear signal. The quality of each of the automatically selected signals is then compared to provide a selected one of the compared signals as an output signal.

A method of transmitting and receiving an information signal includes providing a clear or a privacy encoded signal, selectively transmitting one of said signals through a common transmission medium, and receiving the selected signal. A privacy encoded signal having a scrambled format may be transmitted and received. The received scrambled signal at the receiver may be either regenerated or unscrambled at the receiver according to aspects of the invention. The scrambled signal may also be in a digital format in conformity with another aspect of the invention.

BRIEF DESCRIPTION OF THE DRAWINGS

For a more complete understanding of the invention, references made to the drawings in which.

DETAILED DESCRIPTION OF PREFERRED EMBODIMENTS

Figures 1, 2, 3:
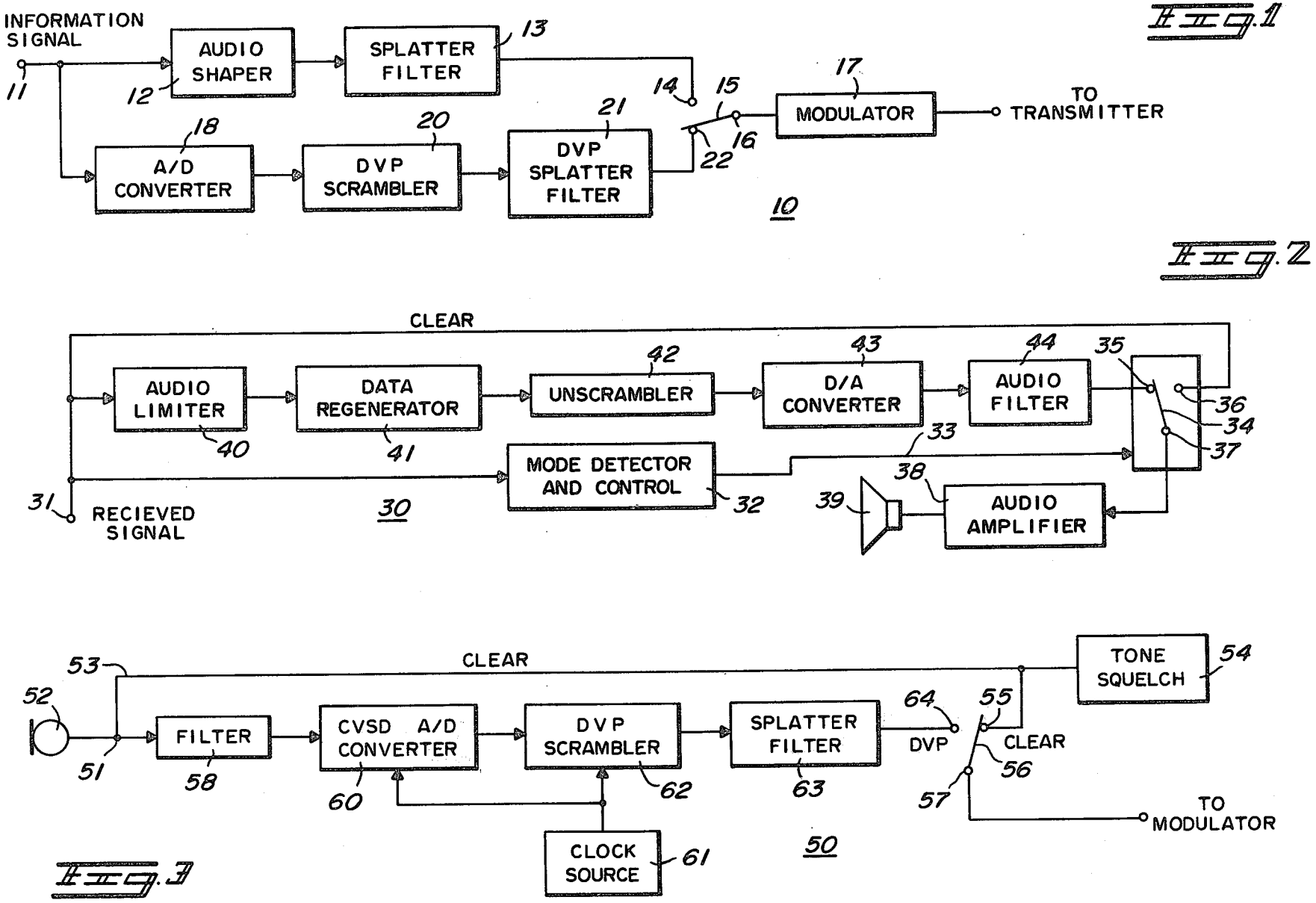
FIG. 1 is a generalized block diagram of a transmitter using the invention.
FIG. 2 is a generalized block diagram of a receiver using the invention.
FIG. 3 is a block diagram of the transmitter portion of a portable radio transceiver using the invention.

Referring to FIG. 1 of the drawings, the block diagram shows a generalized transmitter system 10 which is part of a digital voice privacy electronic communication system adapted to digitally protect an information signal. An information signal, for example, an audio signal, is supplied to input signal line 11 connected to an audio shaper circuit 12 which appropriately shapes the audio information signal characteristics, for example, providing preemphasis on a frequency modulated system. A splatter filter 13 connected to the audio shaper circuit 12 provides a signal output conforming to a particular radio communication system performance standard. After passing through the audio shaper circuit 12 and the splatter filter 13, the information signal then appears at an information signal terminal 14 of a switch 15, having an output terminal 16 which is coupled to a modulator 17, the modulated output of which feeds other transmitter circuits.

The input signal line 11 also feeds the information signal, which may be in an analog form to an A/D converter 18, an analog to digital converter, which converts the analog information signal to a digitally coded representative format. The digital signal output of the A/D converter 18 is sent to a digital voice privacy scrambler 20, hereinafter called a DVP scrambler, which using a code key puts the digital information in a form unintelligible to unauthorized receptors of said signals, thereby providing privacy for the information signals. One form of a DVP scrambler-unscrambler is disclosed in U.S. Pat. No. 3,639,690 issued to William V. Braun and Albert J. Leitech and assigned to the assignee of the present invention. The output of the DVP scrambler 20 is fed to a DVP splatter filter 21, a low pass filter for removing out-of-band frequency components to prevent undesired transmitted signals. The output of the DVP splatter filter 21 is then fed to terminal 22 of switch 15. Switch 15 may be a manually controlled switch, which an operator of the system may use to selectively transmit the information signal in a clear (unscrambled) mode or in a scrambled mode.

Referring to FIG. 2, a generalized receiver system 30 has a received signal on the received input signal line 31 which is fed from a signal receiving and detecting means (not shown) appropriate to the particular communication system being used. A mode detector and control circuit 32 having the received signal coupled thereto determines whether the received signal is either a clear or a scrambled signal. For any particular scrambled signal format the mode detector and control circuit 32 utilized would vary dependent upon the scrambled signal format. One such system is disclosed in U.S. Pat. No. 3,995,225 assigned to the assignees of the present invention and issued to Paul H. Horn, entitled "Synchronous, Non Return To Zero Bit Stream Detector". The mode detector and control circuit 32 provides an output control signal on line control line 33 which controls the position of switch 34. The switch connects the signal present at either an unscrambled information terminal 35 or a clear information terminal 36 to an output terminal 37. The signal at terminal 37, as will be described hereinbelow, is in clear form and is sent to an audio amplifier circuit 38, which feeds a speaker 39.

If the mode detector and control circuit 32 determines that the signal present on receiver, input line 31 is not a scrambled signal, that is, that the received signal is a clear, or unscrambled, information signal, switch 34 is set to connect terminal 36 to the output terminal 37 thereof. If, however, the mode detector and control circuit 32 determines that the received signal is a scrambled signal, the switch is automatically set to couple the unscrambled signal present on terminal 35 to the output terminal 37. A scrambled receive signal present on input signal line 31 is fed to an audio limiter circuit 40 which limits the peak excursions of the received signal. The signal is then fed to a data regenerator circuit 41 which shapes and retimes the data signal. The regenerated signal still in scrambled form is fed to an unscrambler circuit 42 which may also be of the type disclosed in U.S. Pat. No. 3,639,690, supra, and which contains a predetermined code key for processing the scrambled data input signal to produce an unscrambled output data signal. The unscrambled output data signal is fed to a D/A converter 43 which produces at its output a signal representative of the information signal which had been originally transmitted. The output of the D/A converter 43 is then fed to an audio filter 44 of the low pass type which removes higher order distortion and quantizing error components of the digital-to-analog conversion process and provides at the output thereof an unscrambled information signal at terminal 35 of the switch 34.

Figure 4:
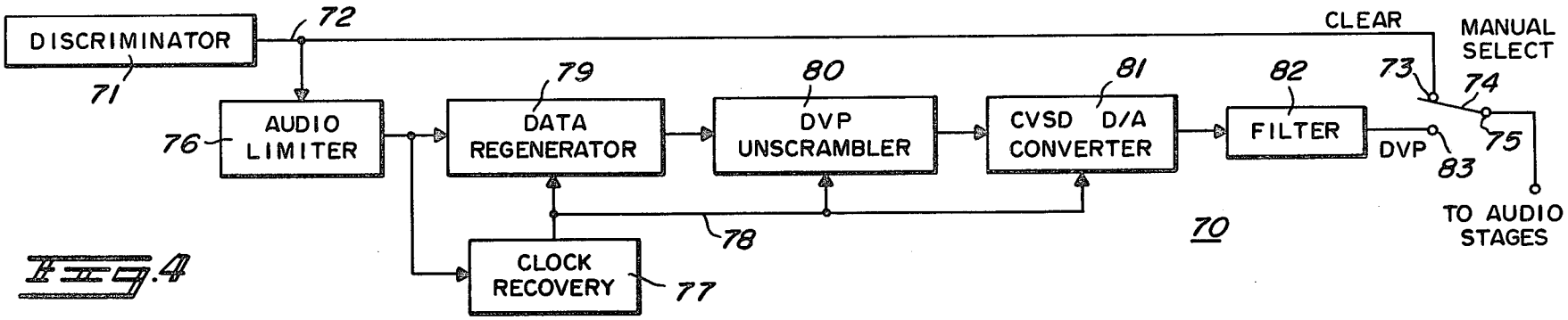
FIG. 4 is a block diagram of the receiver portion of a portable radio transceiver using the invention.

Referring to FIG. 3 and to FIG. 4, block diagrams are shown, of component subsystem for a DVP (digital voice privacy) portable transceiver. FIG. 3 shows a portable transmitter portion 50 having an input signal line 51 which receives an audio signal from an audio source such as represented by a microphone 52. A clear information signal path 53 carries the signal produced by the microphone 52 as well as a tone signal produced by a tone-control squelch circuit 54 which is used for a tone controlled squelch subsystem. The clear information signal is terminated at a terminal 55 of switch 56, the output terminal 57 of which is connected to modulator circuits of the transceiver transmitter portion. The input signal line 51 also provides a signal from the microphone 52 to a low pass filter 58, the output of which is fed to a continuously variable slope delta modulator A/D converter 60, hereinafter designated CVSD A/D converter, which is synchronously clocked by a signal from a clock source 61 at a predetermined rate, for example a 12 kilobit per second rate. The CVSD A/D converter 60 is a form of delta modulation which effectively compands the analog input and output signals to and from the delta modulator and, in conjunction with the 12 kilobit per second sampling rate, provides a reproduced signal of adequate quality for many voice communication applications requiring a restricted band width signal. The clock source 61 also synchronously clocks a DVP scrambler 62, which may be of the type disclosed in FIG. 1. The output of the DVP scrambler 62 is fed to a splatter filter 63 which removes high frequency components from the scrambled data signal. The DVP signal is then fed to terminal 64 of switch 56, which is a manual switch by which either a clear or a scrambled version of an information signal may be selectively coupled to the modulator circuits of the portable transmitter.

FIG. 4 shows a portable transceiver receiver portion 70 block diagram. Although many types of radio transceivers may be employed in utilizing the present invention, this embodiment of a portable transceiver employs a frequency modulated carrier scheme, which uses a frequency discriminator circuit 71 for detecting the modulated signal and which supplies a received signal on a signal line 72 which feeds a clear information signal to a terminal 73 of a manually operated switch 74, having an output terminal 75 to which are connected audio stages for receiving and processing the received audio signals. Signal line 72 also feeds the received signal to an audio limiter circuit 76 which limits the excursions of the input audio signal and which feeds an output signal to a clock recovery circuit 77 which derives an output clock signal representative of the transmitter clock signal. One such clock recovery means for use with a particular data signal format is disclosed in U.S. Pat. No. 3,983,498 issued to Charles J. Malek, entitled "Digital Phase Lock Loop" and assigned to the assignee of the present invention. The output of the clock recovery circuit 77 is fed on a synchronous clock line 78 to a data regenerator circuit 79 wherein the data signal is reshaped and retimed, the output being fed to a DVP unscrambler circuit 80, which is also synchronously clocked by a synchronous clock on synchronous clock line 78. The output of the DVP unscrambler 80 is fed to a CVS digital-to-analog converter 81 which produces a signal representative of the original microphone signal at the transmitter. The D/A converter output signal is low pass filtered by filter 82 which removes out of band quantizing noise and provides a signal which is fed to a DVP terminal 83 of the manually operated switch 74. Using switch 74, an operator may manually select either the clear or the DVP signal to be applied to the audio stages of the transceiver.

Figure 5:
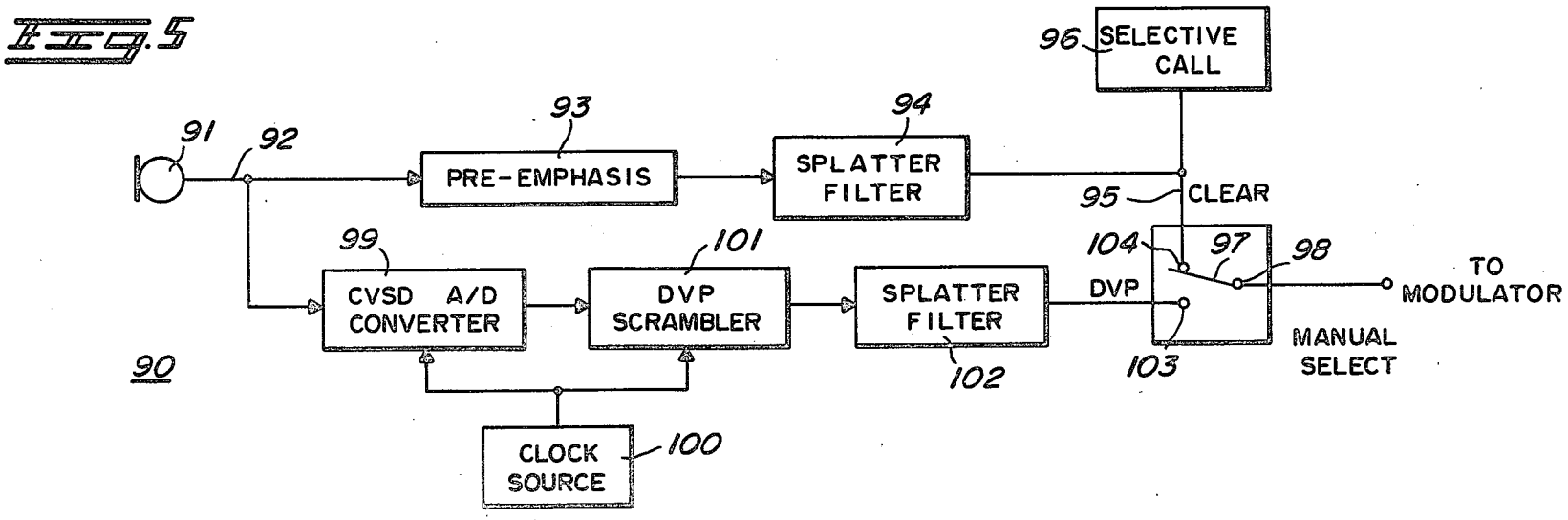
FIG. 5 is a block diagram of the transmitter portion of a mobile transceiver using the invention.
Figure 6:
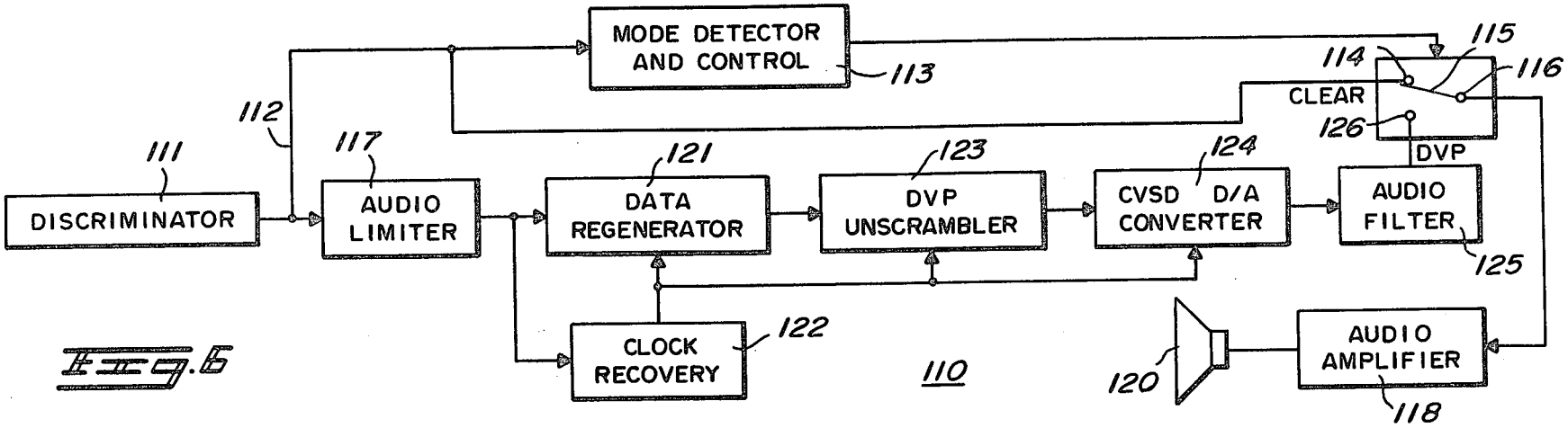
FIG. 6 is a block diagram of the receiver portion of a mobile transceiver using the invention.

Referring to FIG. 5 and FIG. 6, a transmitter portion 90 and a receiver portion 110 of a mobile transceiver are shown. A microphone 91 supplies an audio signal to signal line 92 which feeds the audio signal to a pre-emphasis circuit 93, such as used in a frequency modulated system, and therefrom to a splatter filter 94. The output of the splatter filter 94 is provided on a signal line 95 to which is also coupled the output of a tone-coded selective call squelch circuit 96. Signal line 95 couples a clear signal to a terminal 104 of switch 97 which is manually operated and provides an output signal at terminal 98 said terminal 98 feeding frequency modulation circuits. The signal line 92 also feeds the microphone audio signal to CVSD A/D converter 99, which is synchronously clocked from a clock source 100, which also clocking a DVP scrambler 101, the output of which is fed through splatter filter 102 to provide a DVP signal at terminal 103 of the manually operated switch 97.

FIG. 6 shows a block diagram of the mobile receiver portion 110 including a discriminator 111 frequency detector having a signal line 112 coupled to a mode detector and control circuit 113, feeding a clear audio terminal 114 of an automatically selected switch 115, having an output terminal 116. The signal provided at an output terminal 116 of the switch 115 is fed to an audio amplifier 118 which in turn feeds a signal to a speaker 120. The output of an audio limiter 117 is fed to a data regenerator 121 and a clock recovery circuit 122, which provides a synchronous clock for data regenerator 121, a DVP unscrambler 123, and a CVSD D/A converter 124 which has an output fed to a low pass audio filter 125, the output of which is fed to a DVP terminal 126 of the automatically operated switch 115.

Figure 7:
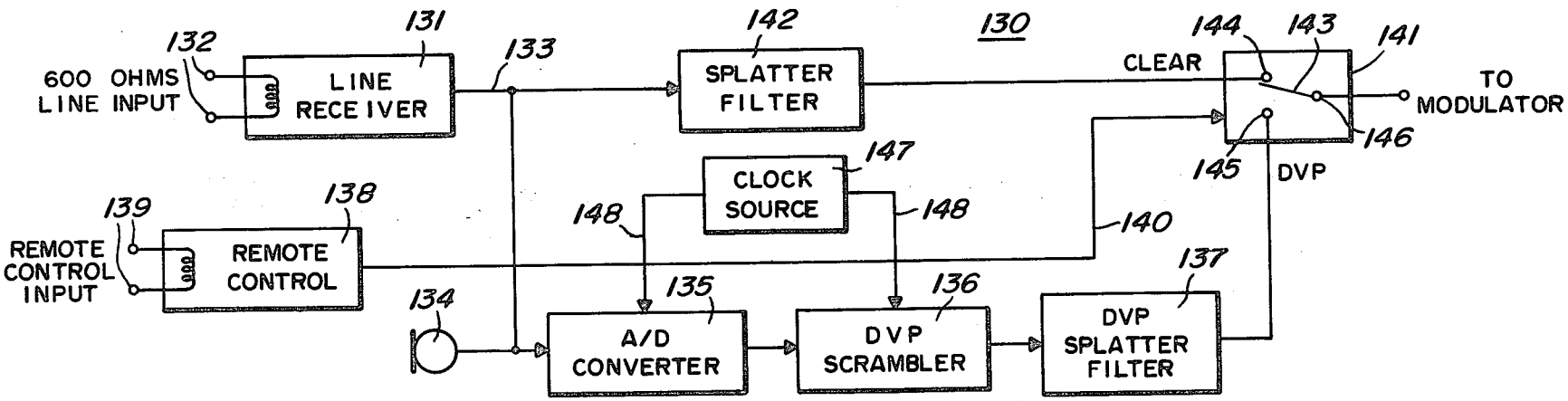
FIG. 7 is a block diagram of the transmitter portion of a base station using the invention.
Figure 8:
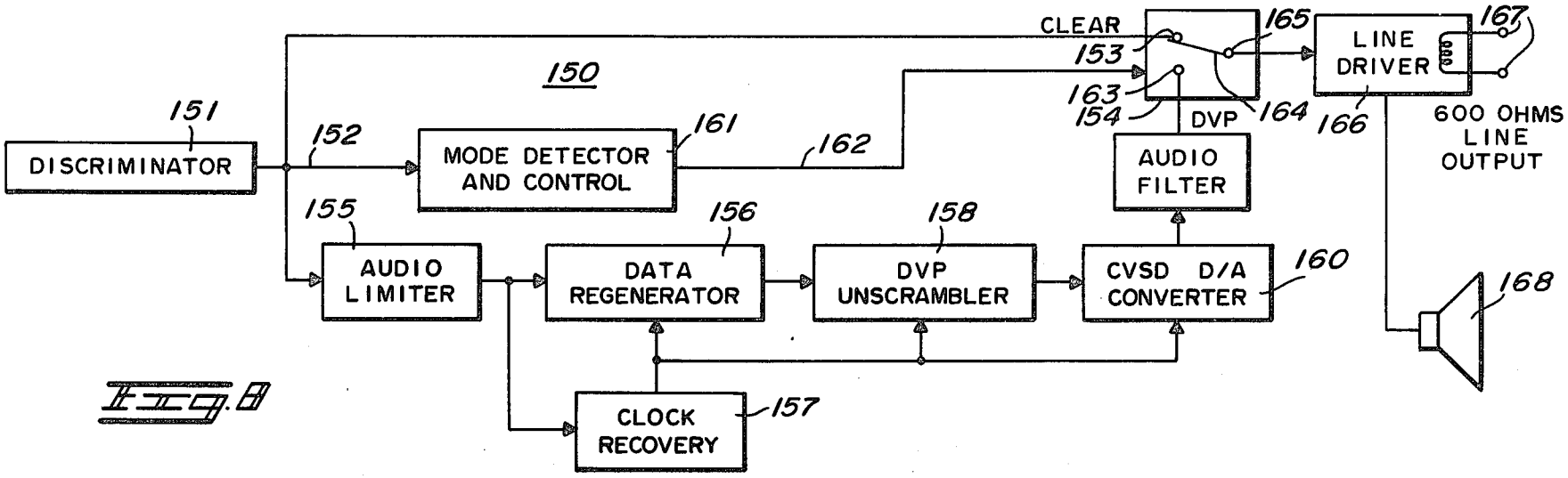
FIG. 8 is a block diagram of the receiver portion of a base station using the invention.

FIG. 7 and FIG. 8 show block diagrams of base station configurations using the present invention. Referring to FIG. 7, the transmitter portion 130 of a base station block diagram shows a line receiver circuit 131 having input terminals 132 to which are fed an audio input signal from a 600 ohm line. A signal line 133 is connected to the receiver circuit 131 output or to a local base station microphone 134, which supplies audio signals from a base station operator. Signal line 133 feeds either the remotely generated audio signal from the 600 ohm line input or the locally generated microphone audio signal to a scrambler subsystem including A/D converter 135 and a DVP scrambler 136, the output of which is fed to a splatter filter 137. A clock source 147 feeds a synchronous clock signal on clock line 148 to the A/D converter 135 and the DVP scrambler 136. A remote control tone signal is fed to input terminals 139 of a remote control circuit 138, which provides an output control signal on a line 140 for automatically controlling a switch means 141 which allows either clear audio signals from a splatter filter 142 or a DVP signal from another splatter filter 137 to be switched by a switch 143 from either a terminal 144 or a terminal 145 to an output terminal 146. The signal is then fed from terminal 146 to modulator circuits following.

Referring to FIG. 8, a block diagram is shown of a receiver portion 150 of a base station which has a discriminator 151 which provides by means of signal line 152 a clear audio signal to terminal 153 of switch means 154. Signal line 152 also feeds the discriminator output signal to audio limiter 155, the output signal of which is fed to a data regenerator circuit 156 and a clock recovery circuit 157, said clock recovery circuit 157 providing a synchronous clock signal to the data regenerator 156, a DVP unscrambler 158, and a CVSD D/A converter 160. The signal line 152 also feeds a signal to a mode detector and control circuit 161 the output of which is on control line 162 for automatically selecting either a clear signal at terminal 153 and a DVP signal at a terminal 163 of switch means 154, which switches a switch 164 having an output terminal 165. The signal at output terminal 165 feeds a line driver circuit 166 which has output terminals 167 which provide an output signal to a 600 ohm line. The line driver 166 also provides an audio signal to a local speaker 168.

Figure 9:
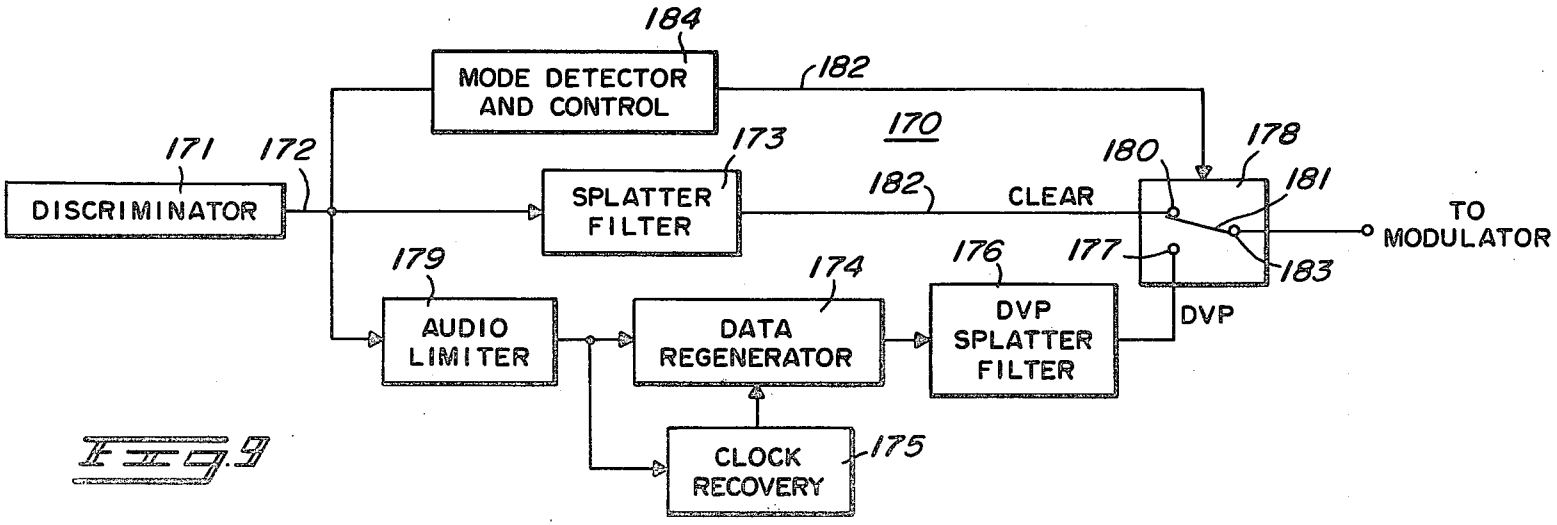
FIG. 9 is a block diagram of a repeater using the invention.

Referring to FIG. 9, a repeater 170 block diagram is shown. Since a repeater is often times located at a remote and sometimes unsupervised location, no DVP unscrambling equipment is provided at such a location, thereby preserving scrambled information from unauthorized intrusion. A discriminator 171 provides an output signal on signal line 172 to a mode detector and control circuit 184, a clear signal splatter filter 173, and an audio limiter 179. The audio limiter 179 output is fed to a data regenerator 174 and a clock recovery circuit 175, which provides a synchronous clock for regeneration of the data in the data generator 174. The output of the data regenerator circuit 174 is filtered by a DVP splatter filter 176 and fed to a DVP terminal 177 of a switch means 178. A terminal 180 has the clear audio output signal from the splatter filter 173 provided thereupon. Switch 181 is controlled by the control output signal of the mode detector and control circuit 184 which appears on control signal line 182 and which automatically controls switch 181. The output of switch 181 appears on terminal 183, which is connected to the transmitter modulator circuits of the repeater transmitter. A repeater system as described only regenerates, that is, retimes and reshapes the data signal without unscrambling the signal.

Figure 10:
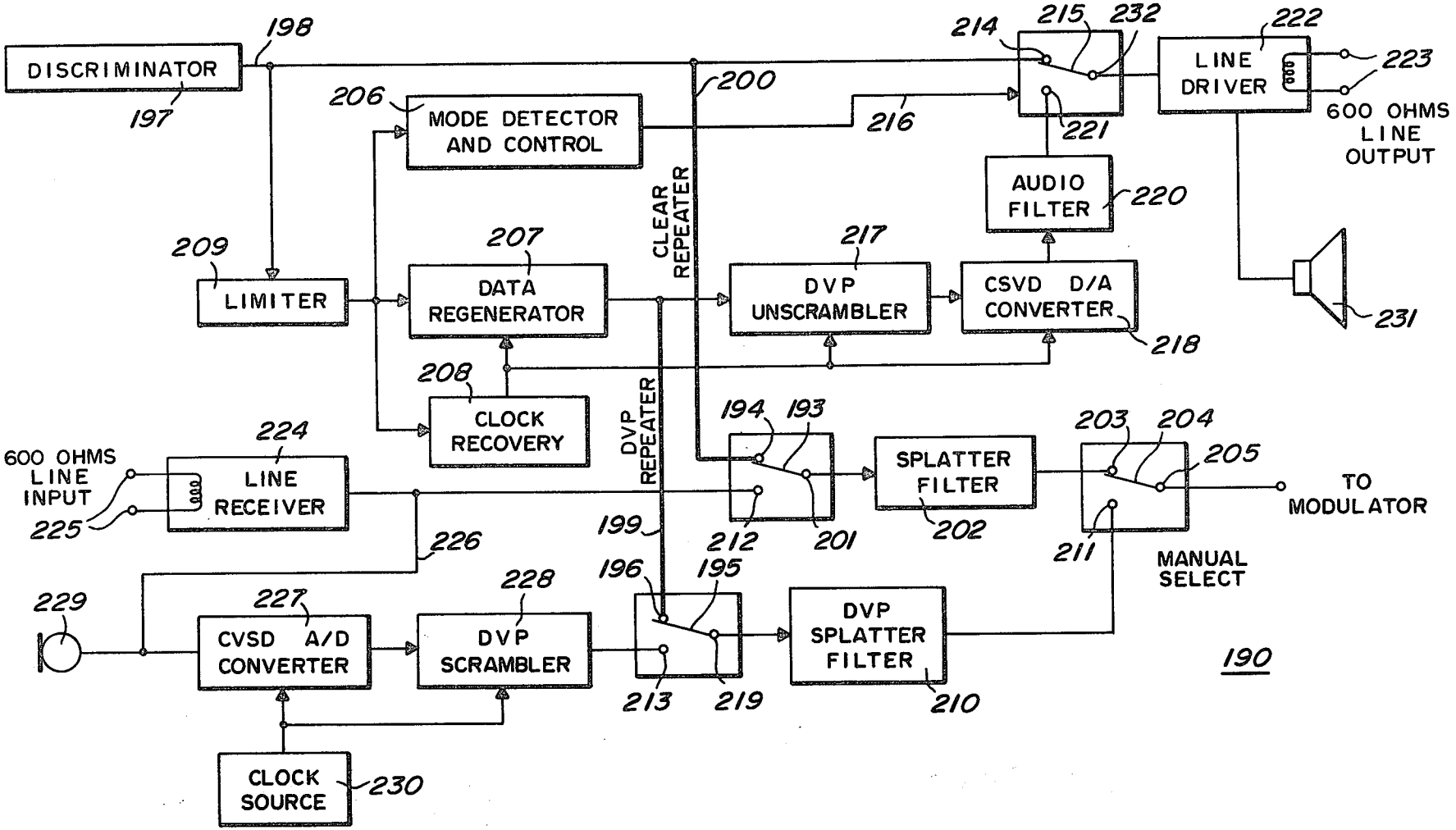
FIG. 10 is a block diagram of fixed base station/-repeater station using the invention.

FIG. 10 shows a block diagram of a fixed base station/repeater station 190. Operation of the station in the repeater mode will be discussed first and then operation of the station in the base station mode will be discussed.

When operating in the repeater station mode, a clear audio switch 193 contacts an input terminal 194 and a DVP switch 195 contacts an input terminal 196, providing signal paths as will be described hereinbelow. A discriminator 197 provides an output signal on signal line 198 which is fed to a clear repeater signal line 200, through terminal 194 of switch 193, to terminal 201 of switch 193, and to a splatter filter 202. The output of the splatter filter 202 is fed to a terminal 203 of a manually operated switch 204, the output terminal 205 of which is connected to the modulator circuit of the repeater transmitter. The signal line 198 also feeds a discriminator output signal to a limiter 209, the output of which is fed to a mode detector and control circuit 206, a data regenerator 207, and a clock recovery circuit 208. The clock recovery circuit 208 provides a synchronous clock for the data regeneration circuit 207, the output of which is connected to a DVP repeater signal line 199 connected to a DVP switch 195 input terminal 196. The signal is then passed through a splatter filter 210 to a terminal 211 of the manually operated switch 204. The repeater station operational mode is very similar to that shown in FIG. 9.

When the system operates in the base station mode, the clear audio switch 193 contacts a terminal 212 and the DVP switch 195 contacts a terminal 213. With the switches in that position, output signals from discriminator 197 are not coupled to the repeater modulator circuits. The clear audio signal present on signal line 198 feeds a terminal 214 of a switch 215. The mode detector and control circuit 206 output signal on the control line 216 automatically control switch 215. Clock recovery signal 208 output signal also synchronously clocks a DVP unscrambler 217 and a CVSD D/A converter 218, which provides an output signal which is filtered by an audio filter 220 and fed to a terminal 221 of an automatic selector switch 215. The output of switch 215 appearing at a terminal 232 is fed to a line driver 222 which provides an output signal to terminals 223 for driving a 600 ohm line and also provides an output to a local speaker 213.

When the fixed base station/repeater station 190 operates in the fixed base transmit mode, a line receiver 224 is fed an audio signal at input terminals 225 from a 600 ohm line. The output of the line receiver 224 is fed to a signal line 226 which also has the output of a local base station microphone 229 coupled thereto. The clear signal on signal line 226 is fed through switch 193 and the splatter filter 202 to a terminal 203 of manually selected switch 204. The signal line 226 also feeds a CVSD A/D converter 227, the output of which feeds a DVP scrambler 228. A clock source 230 provides synchronous clock signals for the CVSD A/D converter 227 and the DVP scrambler 228. The output of the DVP scrambler 228 is fed through switch 195 to the DVP splatter filter 210, which feeds terminal 211 of switch 204. The output of switch 204 at terminal 205 then feeds a modulator circuit of the transmitter. In the fixed base station operation mode the fixed base/- repeater station operates very similarly to the base station configurations shown in FIG. 7 and FIG. 8.

Figure 11:
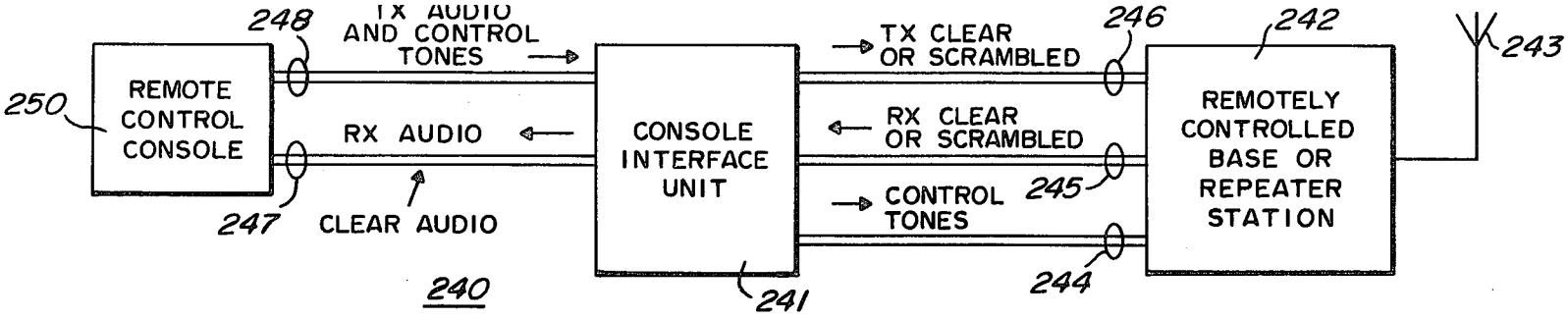
FIG. 11 is a block diagram of a system having a console interface unit (CIU) interfaced with a base station or repeater.

Referring to FIG. 11, a block diagram of a system 240 using a console interface unit 241, hereinafter designated as CIU, is shown. A remotely controlled base or repeater station receives control tones on a line 244 from the CIU 241. The remotely controlled base or repeater station 242 sends either clear or scrambled signals from its receiver section to the CIU 241 on line pair 245. The remotely controlled base or repeater station 242 is fed either clear or scrambled audio signals from the CIU 241 on line pair 246. It is noted that the scrambled signals are in a secure format so that the signal lines 245 and 246 connecting the CIU 241 to the remotely controlled base or repeater station 242 have privacy signals thereupon which are secure against unauthorized intrusion. This allows the remotely controlled base or repeater station 242 to be physically located at unattended sites as distances far from the CIU 241 while still maintaining message security.

In the CIU, as will be described hereinbelow, is contained suitable equipment for scrambling and unscrambling information signals. The signals which have been unscrambled in the CIU are fed to a remote control console in a clear unscrambled form on line pair 247. Similarly, signals which are to be scrambled in the CIU and control tone signals for the remotely controlled base or repeater station 242 are fed to the CIU 241 from the remote control console on line pair 248. Since the signals on line pairs 247 and 248 are not secure, it is desirable that the CIU 241 be physically located very near to the remote control console 250 to prevent intrusion into the messages on line pairs 247 and 248.

The remotely controlled base or repeater station 242 contains no scrambling or unscrambling equipment and is therefore secure from intrusion by unauthorized personnel so that it may be remotely located.

Figure 13:
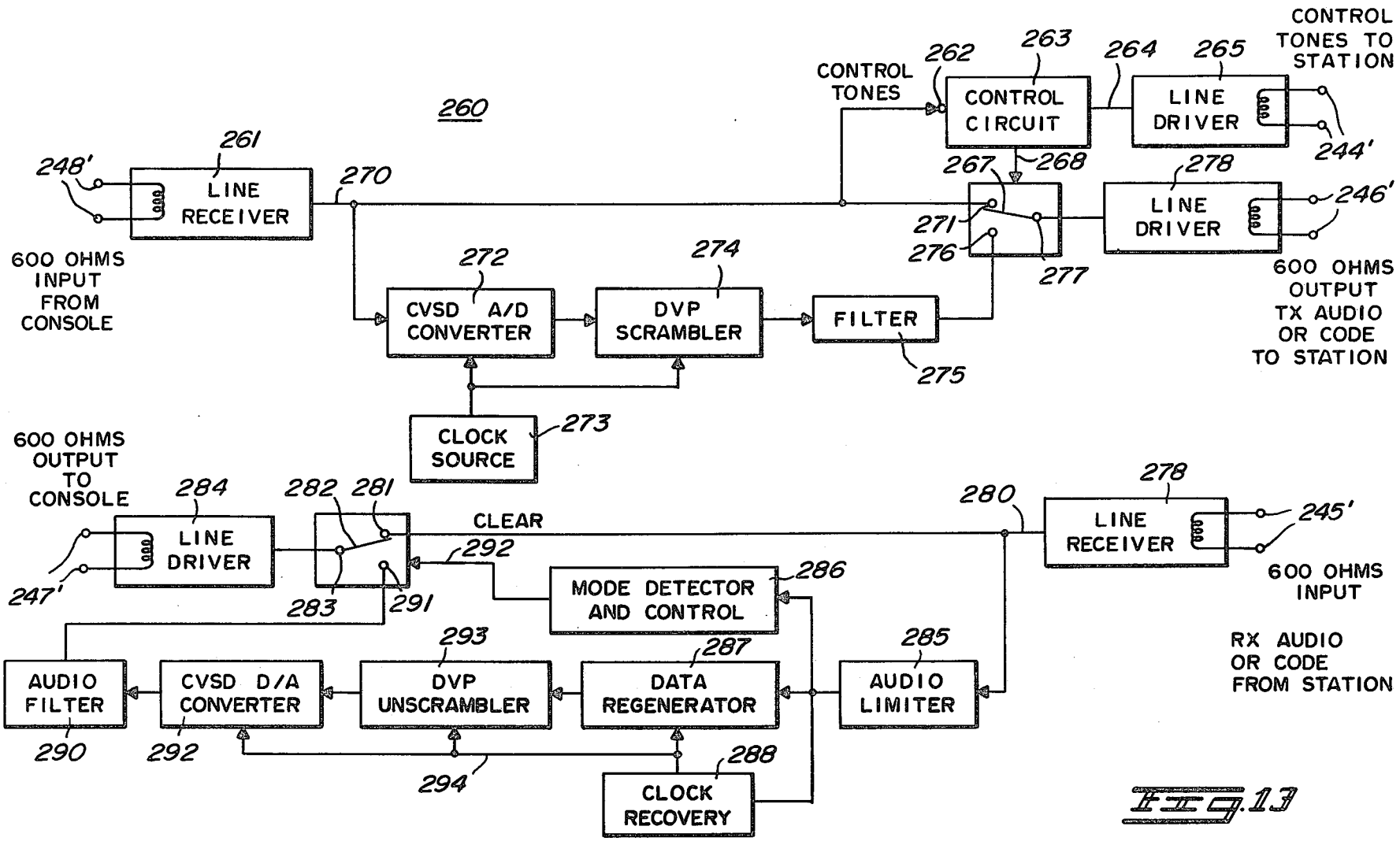
FIG. 13 is a block diagram of a console interface unit (CIU)

Referring to FIG. 13, a more detailed block diagram of a console interface unit 260 shows terminals 245', 246', 247' and 248'. respectively designating the connection points for line pairs 245, 246, 247 and 248. The signal at terminals 248' control tones and unscrambled information provided thereto by line pair 248 from a remote control console 250. A line receiver 261 provides the control tones to a terminal 262 on a control circuit 263. The control circuit 263 provides output tones on the signal line 264 which feeds line driver 265, having output terminals 244' to which is connected line pair 244 for providing control tones to the remotely controlled base or repeater station 242.

The control circuit 263 as directed by the control tones received at terminal 262 controls the position of switch 267 by means of control line 268.

The signals from the output of line receiver 261 are also fed to signal line 270 which is connected to a terminal 271 of switch 267 and to a CVSD A/D converter 272 which is fed clock signals from a clock source 273, which also feeds a DVP scrambler 274. The output of the DVP scrambler 274 is fed to a low pass filter 275, the output of which is connected to a terminal 276 of switch 267. The signal appearing at output terminal 277 of switch 267, which may be either clear or scrambled, is fed to line driver 278, the output terminals 246' of which feed the signal to the 600 ohm line pair 246 for providing clear or scrambled signals to the remotely controlled base or repeater station 242.

The remotely controlled base or repeater station 242 provides clear or scrambled received signals on line pair 245 connected to terminals 245' of line receiver 278, the output of which appears on signal line 280. The clear signal is coupled to terminal 281 of switch 282, which has an output terminal 283 for feeding a signal to line driver 284. The output of line driver 284 at terminals 247' is fed by the 600 ohm line pair 247 to the remote control console 250. Signal line 280 also feeds a signal to audio limiter 285, the output of which is fed to a mode detector and control circuit 286, a data regenerator circuit 287, and a clock recovery circuit 288, the output of which on clock line 294 clocks the data regenerator circuit 287, a DVP unscrambler 293, and a CVSD D/A converter 292. The data regenerator circuit 287 output is fed to the DVP unscrambler 293 which, in turn, feeds a CVSD D/A converter 292. The CVSD D/A converter 292 feeds an audio filter 290 the output of which feeds terminal 291 of switch 282, said switch being automatically controlled by a control signal on control line 292 from the output of the mode detector and control circuit 286.

Since the CIU circuit 260 provides for all of the scrambling and unscrambling functions a wide variety of remote control consoles may be accommodated in a system utilizing the present invention when a CIU is provided.

Figure 12:
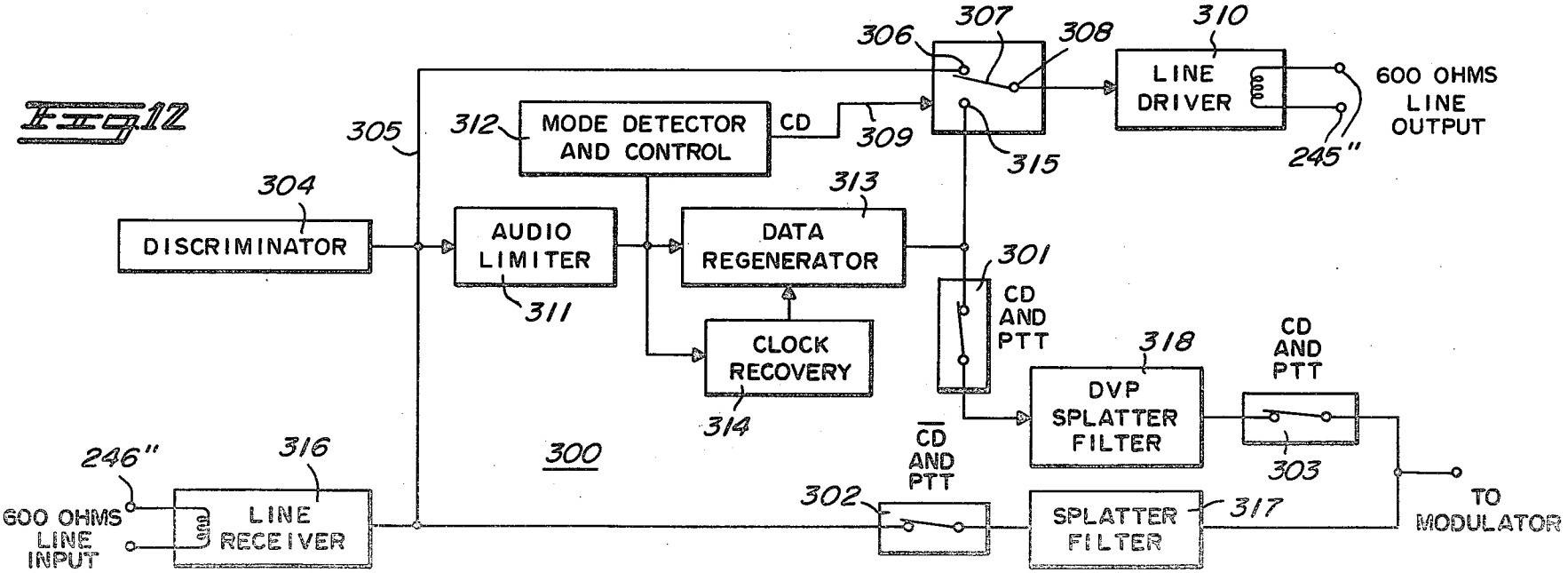
FIG. 12 is a block diagram of a remotely controlled transparent base station using the invention.

Referring to FIG. 12, a remotely controlled base or repeater station is shown. It is noted that no scrambling or unscrambling functions are performed in a remotely controlled station.

It is noted that terminals 245" and 246" are respectively connected to line pairs 245 and 246. The system shown in FIG. 12 may function either as a remotely controlled base or as a repeater station. Each mode of operation is separately discussed.

When the system is operated as a remotely controlled base station in the receive mode, switches 301, 302 and 303 are in the open position. A discriminator 304 feeds an output signal to signal line 205 which is connected to terminal 306 of switch 307, the output terminal 308 of which feeds a signal to a line driver 310, which provides an output signal at terminals 245" to line 245, which is connected to the CIU 241 receiver circuits. Signal line 305 is also connected to an audio limiter 311, the output of which is connected to a mode detector and control circuit 312, a data regenerator circuit 313, and a clock recovery circuit 314, the output of which provides a synchronous clock for the data regenerator circuit 313. The data regenerator circuit 313 output is connected to a terminal 315 to switch 307 which is controlled automatically by a control signal CD on a control line 309. Signal CD is present when scrambled signals are present.

When the system is operated as a remotely controlled base station in the transmit mode, switches 301 and 303 are closed if the signal present on signal line 305 is a scrambled signal as determined by the mode detector and control circuit 312 output signal CD. Operation in the transmit mode is indicated by a PTT signal being present. PTT indicates the operator has activated a push-to-talk circuit to place the system in the transmit mode of operation. Switch 302 is closed if the signal present on signal line 305 is a clear signal. A signal from the CIU 241 is fed to terminals 246" of a line receiver 316. If the output signal of line receiver 316 is a clear signal, switch 302 is closed and the signal is fed to splatter filter 317 and from thence to frequency modulator circuits in the transmitter. If the signal present on signal line 305 is a scrambled signal, a regenerated signal from the output of the data regenerator 313 will be fed to the input of the DVP splatter filter 318 through switch 301. The output of the splatter filter is then fed through switch 303 to modulator circuits of the transmitter.

When the system shown in FIG. 12 is operated as a repeater, the signal on signal line 305 is obtained from the discriminator 304 and is coupled through switches 301, and 303 if it is a scrambled signal or through switch 302 if it is a clear signal.

Figure 14:
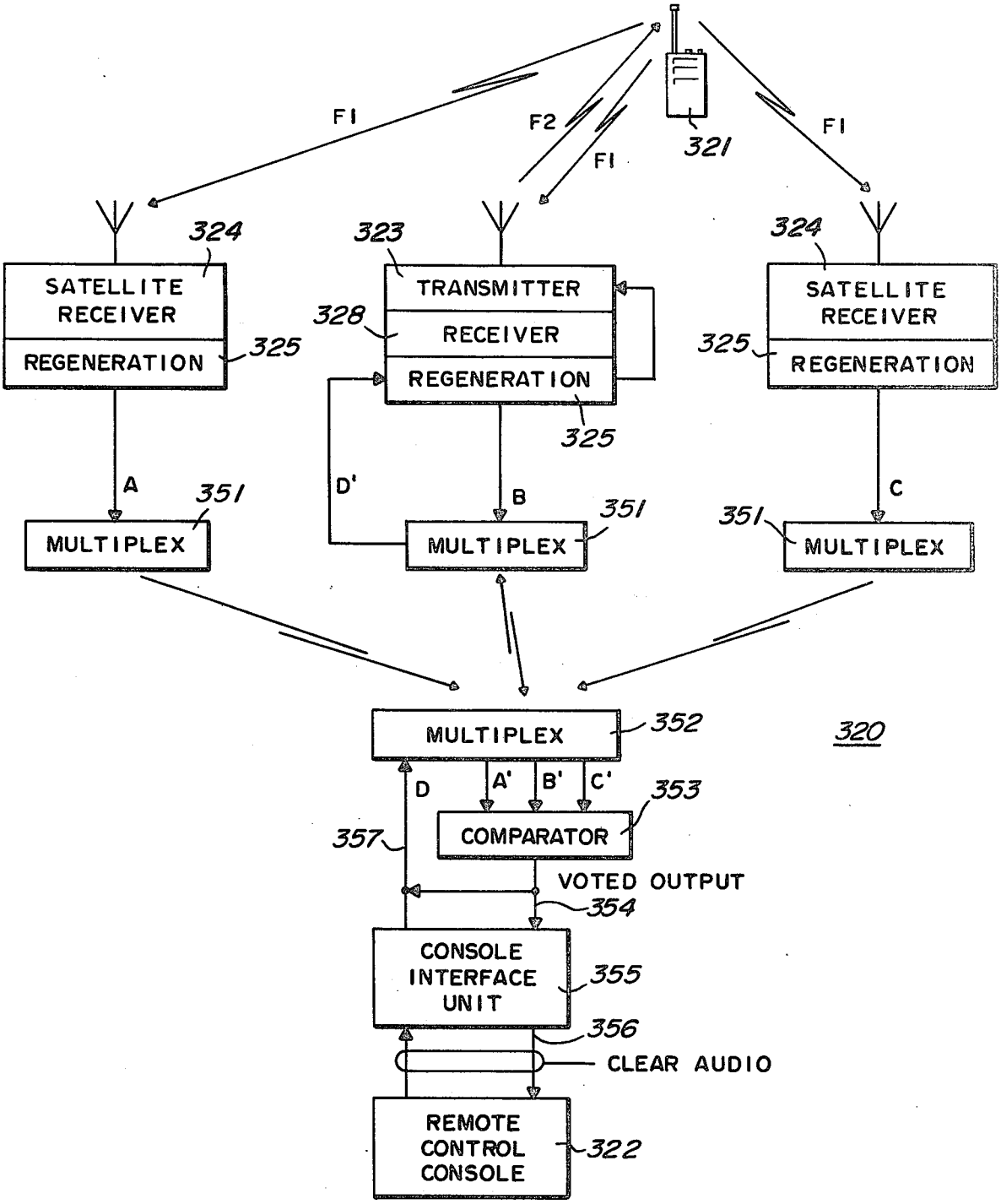
FIG. 14 is a block diagram of a satellite receiver system using the invention.
Figure 15:
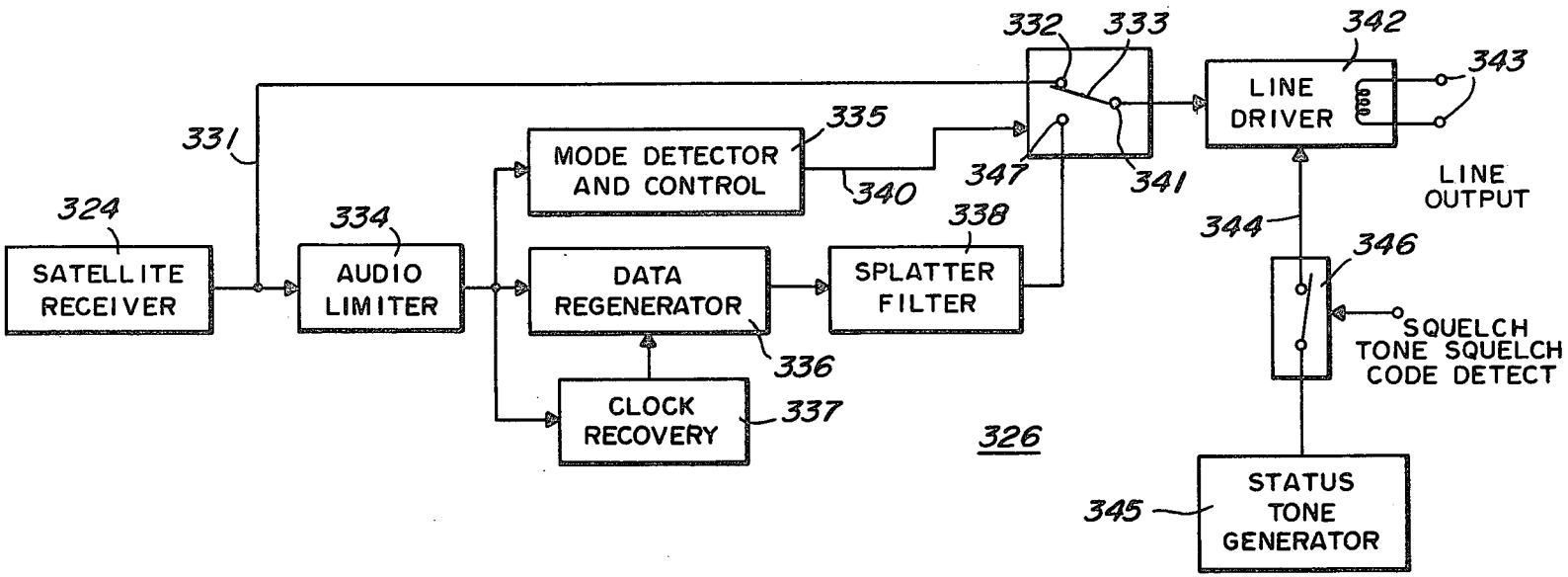
FIG. 15 is a block diagram of a satellite receiver using the invention.

Referring to FIG. 14, a transparent receiver voting system with satellite receivers and a repeater system 320 is shown. Such a system is used when a low transmitter power portable transceiver 321 must maintain good communications with a remote control console 322. Information from a remote control console 322 is transmitted by means of a transmitter 323 to the portable transceiver 321 on a frequency designated F2. Since the signal F2 is transmitted from a relatively high power transmitter 323, the signal on frequency F2 is always strongly received by the portable 321. However, since the portable 321 itself has low transmit power, the signals which it transmits on a frequency designed F1 may be weakly received by a receiver 328 at the same location as the transmitter 323 when the portable 321 moves away from said fixed location receiver. To overcome this limitation a plurality of satellite receivers 324 tuned to frequency F1 are located at various sites within the intended service area of portable transceiver 321. Contained within each satellite receiver station 324 are regeneration circuits 325. Referring now to FIG. 15, a satellite receiver and regeneration combination system 326 is shown equivalent to a satellite receiver 324 and a regeneration circuit 325 of FIG. 14. In FIG. 15 satellite receiver 324 provides a received audio signal on signal line 331 which is coupled to a terminal 332 of a switch 333. The signal line 331 also feeds on audio limiter 334, the output of which feeds a mode detector and control circuit 335, a data regenerator circuit 336, and a clock recovery circuit 337, the output of which is a synchronous clock signal for controlling the data regenerator circuit 336. The output of the data regenerator circuit 336 is sent to a splatter filter 338, the output of which is fed to a terminal 347 of switch means 333, which is automatically controlled by a control signal on control line 340. The output terminal 341 of switch 333 feeds a signal to the line driver 342 which has output terminals 343. Also being fed to the line driver 342 is a signal on a signal line 344 from a status tone generator 345, the output of which is operated to a switch means 346 is response to a squelch, a tone squelch or a special code detect signal.

Referring again to FIG. 14, the output signal of each of the satellite receiver 324 regeneration circuits 325 designated in FIG. 14 as A and C are fed to respective multiplex equipment 351 and transmitted by means such as microwave links or phone lines to further multiplex equipment 352 which have outputs A′ and C′, representative of the signals A and C. Similarly, the receiver 328 regeneration circuit 325 provides an output signal B which appears at the output of multiplex equipment 352 as signal B′. All these are fed into a comparator circuit 353 which picks either the strongest clear analog signal or the best digital scrambled signal by a voting technique and provides a voted output signal at an output terminal 354 thereof. The voted output signal is then sent through a console interface unit 355 where the signal is unscrambled if it is a scrambled signal. Finally, a clear audio signal output on line 356 is sent to the remote control console 322. A signal to modulate frequency F2 is sent from the remote control console 322 through the console interface unit 355, the multiplex units 352, 351 and to the regeneration circuit 325. The voted output of the comparator on line 354 is added to the console interface unit 355 signal output D on signal line 357. A corresponding signal D′ at the output of multiplex equipment 351 causes the information originally received from the portable transceiver 321 to be retransmitted on frequency F2 to other portable transceivers in the same service area as portable transceiver 321.

It should be noted that the scrambled signals remain in a scrambled form throughout the regeneration, voting multiplex, and comparator operations until the signals are within the console interface unit 355. This provides a high degree of security for such satellite receiver systems.

While particular embodiments of the present invention have been shown and described, it should be understood that the invention is not limited thereto since many modifications may be made. It is contemplated to cover by the present application any and all such modifications that fall within the true spirit and scope of the basic underlying principles disclosed and claimed herein.

What is claimed is:

1. A communication system for the transmission of an information signal comprising:

transmitting means adapted to input said information signal, said transmitting means including: privacy encoding means adapted for predeterminedly encoding said information signal; and means for selectively producing either the clear information signal or the encoded signal at the transmitting means output; and receiving means operable to process a plurality of received transmitted signals from a plurality of satellite receivers, said receiving means including: detector means for automatically analyzing a received signal and determining whether the received signal is said clear information signal or said privacy encoded signal; decoding means adapted to decode a privacy encoded signal: means for providing a control signal indicative of the signal quality of each received clear information signal; means for providing a control signal indicative of the signal quality of each received privacy encoded signal; comparator means for automatically switching one of the received clear information signals or privacy encoded signals to an output terminal thereof in response to said control signals; and means responsive to the detector means to pass the received clear information means to a receiver output and to pass a received privacy encoded signal through said decoding means to the receiving output.

2. A repeater for use in a communication system wherein a transmitter includes means to transmit a clear analog information signal or a digitally encoded information signal and wherein a receiver includes means to process the transmitted signal and decode an encoded information signal, the improved repeater for receiving and retransmitting the transmitted signal comprising:

detector means for automatically analyzing the transmitted signal and determining whether said signal is the clear analog signal or the digitally encoded signal;

regenerating means responsive to the detector means to regenerate a detected digitally encoded signal; and means to retransmit the one of the transmitted analog signal and the regenerated digitally encoded signal, whereby the improved repeater retransmits an enhanced digitally encoded signal without decoding said signal.

3. The improved repeater of claim 2 wherein the regenerating means comprises means to reclock and reshape the digitally encoded signal.

4. In a receiver voting system wherein a plurality of receiver sites simultaneously receive a clear analog signal or a digitally encoded signal transmitted by a transmitter site, the improvement comprising:

means for producing a signal quality control signal representative of the relative quality of the signal, whether analog or digital, being received by each receiver site, said signal quality control signal being produced without decoding a digitally encoded signal; and comparator means for comparing the signal quality control signals and, in response thereto, passing a predetermined one of the plurality of receiver site received signals to an output terminal, whereby the improved voting system is functional without decoding a digitally encoded signal.

* * * * *